US005482369A

United States Patent [19]

Verstallen

[11] Patent Number: 5,482,369

[45] Date of Patent: Jan. 9, 1996

[54] PROCESS FOR HOMOGENIZING ESSENTIALLY IMMISCIBLE LIQUIDS FOR FORMING AN EMULSION

[76] Inventor: Adrian Verstallen, Schiffhorst 208a, D-4600 Dortmund 16, Germany

[21] Appl. No.: 302,635

[22] Filed: Sep. 8, 1994

Related U.S. Application Data

[62] Division of Ser. No. 14,840, Feb. 8, 1993, Pat. No. 5,366, 287.

[51] Int. Cl.[6] ..... B01F 3/08

[52] U.S. Cl. ..... 366/162.4; 366/173.1; 366/176.1

[58] Field of Search ..... 137/604, 606, 137/3, 12; 239/413, 417.5, 545; 252/302, 349; 366/138, 150, 159–162, 167, 173, 176, 182, 336, 337, 348, 162.4, 173.1, 176.1; 422/133

[56] References Cited

U.S. PATENT DOCUMENTS

| | | |
|---|---|---|
| 1,496,858 | 6/1924 | Knollenberg . |
| 3,476,521 | 11/1969 | Wise . |
| 3,788,337 | 1/1974 | Breer . |
| 3,892,389 | 7/1975 | Constantin . |
| 3,941,355 | 3/1976 | Simpson . |
| 4,070,008 | 1/1978 | Schlieckmann . |
| 4,087,862 | 5/1978 | Tsien . |
| 4,108,606 | 8/1978 | Wingard . |
| 4,124,309 | 11/1978 | Yao . |
| 4,378,335 | 3/1983 | Boden et al. . |
| 4,399,104 | 8/1983 | Coblenz et al. . |
| 4,452,919 | 6/1984 | Schneider ..... 366/159 X |
| 4,533,254 | 8/1985 | Cook et al. . |
| 4,721,602 | 1/1988 | Woitzel . |
| 4,778,083 | 10/1988 | Decker . |
| 4,854,713 | 8/1989 | Soechtig . |
| 4,856,908 | 8/1989 | Hara et al. . |
| 5,082,633 | 1/1992 | Stuper . |

FOREIGN PATENT DOCUMENTS

| | | |
|---|---|---|
| 401477 | 9/1924 | Germany . |
| 2023862 | 12/1971 | Germany . |
| 2651433 | 5/1978 | Germany . |
| 363968 | 8/1962 | Switzerland . |
| 438432 | 9/1972 | U.S.S.R. . |
| 89/07007 | 8/1989 | WIPO . |

*Primary Examiner*—Charles E. Cooley
*Attorney, Agent, or Firm*—Herbert L. Lerner; Laurence A. Greenberg; Werner H. Stemer

[57] ABSTRACT

A process for homogenizing essentially immiscible liquids for forming an emulsion comprises the steps of (1) guiding an inner phase towards a mixing region under a given high pressure; (2) guiding an outer phase towards the mixing region under a relatively lower pressure; (3) forming jets in the form of thin, flat sheets with the inner and outer phases; (4) colliding the sheets-like jets of the inner and outer phases substantially in a counter-current and thus forming a phase mixture; and (5) subsequently withdrawing the phase mixture from the mixing region. The apparatus includes two oppositely disposed expansion valves through which the respective phases are fed into the mixing region. The expansion valves are formed of flat-conical valve seats and corresponding valve cones. The mixing region is defined centrally between the two expansion valves. The emulsion is withdrawn directly from the mixing region through an outlet valve, in which it may be exposed to further fine mixing.

1 Claim, 3 Drawing Sheets

PROCESS FOR HOMOGENIZING ESSENTIALLY IMMISCIBLE LIQUIDS FOR FORMING AN EMULSION

This is a division of application Ser. No. 08/014,840, filed Feb. 8, 1993 now U.S. Pat. No. 5,366,287.

BACKGROUND OF THE INVENTION

1. Field of the Invention

The invention relates to a process for homogenizing essentially immiscible liquids for forming an emulsion in which the inner and outer phases are dispersed under pressure, as well as to an apparatus for performing the method.

2. Description of the Related Art

Such a process is known, for instance, from U.S. Pat. No. 4,533,254. A so-called raw emulsion or crude emulsion is first formed in that process for forming an emulsion from two essentially immiscible liquids (e.g. oil and water). The two liquid phases are fed to a premixer and premixed therein, for example by stirring. The premixed liquid thus obtained is then subjected to very high pressure. The pressure depends on the respectively employed inner (dispersed) phase (up to 1,400 bar) because, for dispersing the inner phase into the outer phase, a very large amount of energy is necessary in order to overcome the attractive forces among the particles in the inner phase for the purpose of breaking up the particles. The attractive forces in the inner phase are considerably greater than in the outer phase. The entire raw emulsion is thus pumped to a separation pressure necessary for the inner phase and then very suddenly expanded whereby, in the process according to U.S. Pat. No. 4,533,254, the raw emulsion is divided into two partial streams and collided counter-current in thin sheets from mutually oppositely disposed nozzles. Due to shearing effects and cavitation, the liquid droplets are disintegrated and intensively mixed in the exciting turbulent current.

The known dispersion method therefore requires a substantial amount of energy, since the entire pre-mixed raw emulsion must be pumped to a pressure necessary for the inner phase. Usually, however, the inner phase is only about 5 to 20% of the entire mixture, so that the substantially greater share of the expended energy is applied to the outer phase. This leads to a corresponding great energy loss and also to a substantial warming of the mixture, which is disadvantageous for heat sensitive mixtures. A further disadvantage of the known processes lies in the fact that they can operate only discontinuously, because it is necessary to produce a raw emulsion in a suitable mixing container prior to the actual dispersion.

A process for mixing flowable media is described in Swiss patent CH-PS 363 968, in particular for producing carbonated water. The paper does not disclose a homogenization process for forming an emulsion, the object is instead to finely distribute a gas in a liquid, whereby the two fluids are first oppositely led in a mixing chamber at slightly different pressures and then they are mixed in a further stage.

Other solutions are known, for example, from international application PCT/WO 89/07007, from German published, non-prosecuted applications DE-OS 20 23 862 and DE-OS 26 51 433, and from German patent No. DE-PS 401 474.

It is accordingly an object of the invention to provide a process and an apparatus for homogenizing essentially immiscible liquids for forming an emulsion, which overcomes the hereinafore-mentioned disadvantages of the heretofore-known processes and devices of this general type and which makes possible the production of an emulsion from two essentially immiscible liquids continuously and with substantially lower energy consumption as compared to the prior art processes and apparatus.

SUMMARY OF THE INVENTION

With the foregoing and other objects in view there is provided, in accordance with the invention, a process for homogenizing essentially immiscible liquids for forming an emulsion, which comprises:

- guiding an inner phase of a liquid towards a mixing region under a given high pressure;
- guiding an outer phase of a liquid towards the mixing region under a relatively lower pressure;
- forming jets of thin, radially flat sheets with the inner and outer phases;
- colliding the sheets of the inner and outer phases substantially in a counter-current for forming a phase mixture; and
- subsequently withdrawing the phase mixture from the mixing region.

In other words, the objects are solved with a process of the above-mentioned general type in accordance with the invention, in that the inner phase at high pressure and the outer phase at substantially lower pressure are fed towards each other continuously without premixing and are collided in a counter-current in the form of thin, radially flat sheets and, after the two phases have mixed, the phase mixture is drawn off from the center of the mixing region.

With this process it is surprisingly possible to continuously produce emulsions with a very homogeneously dispersed inner phase under much lower energy expenditure. The two phases are thereby fed in separately from one another under the pressure required for the respective phase, i.e. the inner phase with the necessary separation pressure (depending on the phase characteristics about 1,000 bar for oil) and the outer phase at a substantially lower pressure (approximately up to 100 bar for water). By interacting the two phases in very thin, flat sheets it is surprisingly possible to avoid an agglomeration of particles of one phase, especially of the inner phase; instead, very intensive mixing of all droplets takes place with correspondingly high dispersion. Due to the substantially lower energy consumption, a much lesser amount of dispersion heat is produced during expansion, so that the emulsion thus formed is heated much less as compared to the known processes. This makes the process according to the invention especially suited for heat-sensitive mixtures. Furthermore, because the process may be performed continuously, it may also be used for dispersions for which no satisfactory production methods were previously available (e.g. water and acryl silicate, water and liquefied resins, fluorine, hydrocarbons and pharmaceutically active substances).

In accordance with another feature of the invention, the process comprises, in the jet-forming step, guiding each of the phases through a narrow radially disposed slit and accelerating the respective phase for forming the jets of thin, flat sheets prior to the colliding step.

In other words, for the purpose of forming the jets of thin, flat sheets, each phase is fed and accelerated through a narrow radially disposed slit prior to mixing with the other phase. This process requirement, which is very easily implemented with correspondingly adjustable nozzles through which the respective phase is guided, makes it possible to force the respective phase into a correspondingly thin and flat sheet-like current, so that optimal mixing is assured.

With the objects of the invention in view, there is also provided, in accordance with the invention, and apparatus for homogenizing essentially immiscible liquids for forming an emulsion, which comprises a housing within which the mixing operation takes place; two expansion valves disposed in the housing mutually opposite one another; the expansion valves are formed of flat-conical valve seats and corresponding valve cones; the expansion valves define a mixing region therebetween; means are provided for subjecting an inner phase of a liquid to a given high pressure and for guiding the inner phase towards the mixing region under the given high pressure; means for subjecting an outer phase of a liquid to a relatively lower pressure and for guiding the outer phase towards the mixing region independently of the inner phase; a mixing and outlet valve is disposed centrally between the expansion valves communicates with the mixing region.

In accordance with an additional feature of the invention, the expansion valves are means for forming jets of thin, flat sheets of the inner and outer phases and for colliding the sheets of the inner and outer phases substantially in a counter-current for forming a phase mixture.

The apparatus for performing the novel process is generally characterized by two expansion valves with flat-conical valve seats and corresponding valve cones which are disposed mutually opposite one another, preferably offset by 180°. In the middle between them there is disposed a mixing and outlet valve, in the center of a mixing region or mixing chamber which is bounded by the two expansion valves.

It is possible with this apparatus to expand or relax the separately fed-in phases, which are also subject to very different pressures, in a narrow valve slit or valve clearance and to adjust the two liquid jets to stream in correspondingly thin layers. This ensures an intensive mixing of all liquid particles and droplets during a subsequent collision. It is also advantageous that the central outlet of the mixture through the mixing and outlet valve further leads to an added mixing with a final fragmentation in a turbulent current.

Accordingly, in accordance with a further feature of the invention, the expansion valves are offset relative to one another by substantially 180°.

In accordance with yet an added feature of the invention, the pressure means include a dosing pump for the inner phase associated with one of the expansion valves and a dosing pump for the outer phase associated with the other of the expansion valves.

It is thereby provided that a dosing pump for the respective phase is assigned to each expansion valve. Since the outer phase with the substantially greater liguid flow must be pumped only to a relatively low pressure level, and only the inner phase with the markedly smaller liquid flow must be pumped to the elevated pressure level, no high-power pumps as in the prior art processes are required. It is recalled that, in the prior art, the entire pre-mixed raw emulsion must be elevated to the high pressure level of the inner phase.

In accordance with yet another feature of the invention, the apparatus includes means operatively associated with the expansion valves and with the mixing and outlet valve for allowing adjustment of the valves independently of each another.

This describes a particularly useful embodiment of the invention. All of the valves are adjustable independently from one another. One and the same apparatus can therefore be used for processing different emulsions without having to change the same, only the valve cones need to be adjusted, so that, on the one hand, the inner phase is expanded (pressure is relaxed) and sheared and, on the other hand, the force of the liquid jets can be adjusted individually.

In accordance with yet an additional feature of the invention, the mixing and outlet valve includes an outlet bore formed centrally and axially in the valve cone of one of the expansion valves, and a cylindrical stamp is telescopingly disposed in the valve cone of the other expansion valve, the cylindrical stamp being adjustable independently from that valve cone.

These are very advantageous embodiments of the apparatus. The mixing and outlet valve is formed by an outlet bore which is centrally and axially disposed in the valve cone of the one expansion valve with an inlet at the face of the cone and by a cylindrical stamp, which is telescopingly disposed in the valve cone of the other expansion valve and which is adjustable independently therefrom. The main advantage of this embodiment lies in the fact that very easy handling is possible. It is especially compact and therefore keeps to a minumum sealing problems which exist with these kinds of high-pressure apparatus because of its small construction. It is further ensured that the two phases, prior to mixing and also afterwards, must travel only very short distances, which prevents possible agglomeration of the particles of a phase.

In accordance with an additional feature of the invention, a first one of the two expansion valves includes a first valve stem, the first expansion valve having an axial bore formed therein through the first valve cone and through the first valve stem. The axial bore fluidically connects the outlet bore to an outside of the housing.

In accordance with a concomitant feature of the invention, the second expansion valve includes a second valve stem in the form of a hollow shaft and the cylindrical stamp includes a spindle disposed in the second valve stem.

It is advantageous that the outlet orifice is guided outward via an axial bore through the valve cone and the valve stem. This further limits the construction size of the apparatus to a minimum.

Finally, the apparatus is characterized in that the telescopic stamp has its own spindle, which is disposed in that valve stem of the expansion valve which is formed as a hollow shaft.

Other features which are considered as characteristic for the invention are set forth in the appended claims.

Although the invention is illustrated and described herein as embodied in a process and an apparatus for homogenizing essentially immiscible liquids for forming an emulsion, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
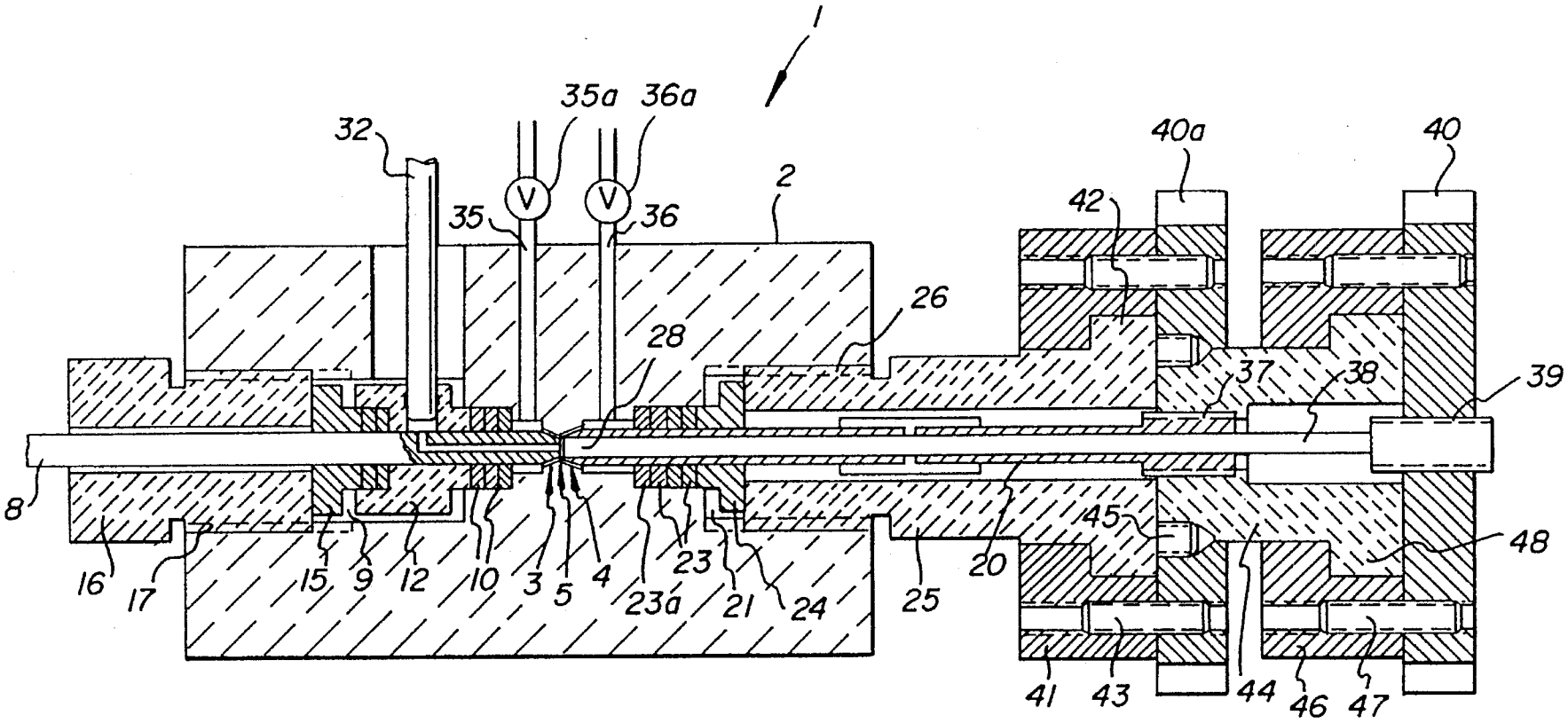
FIG. 1 is a longitudinal cross-sectional view of the apparatus for performing the process according to the invention.
Figure 2:
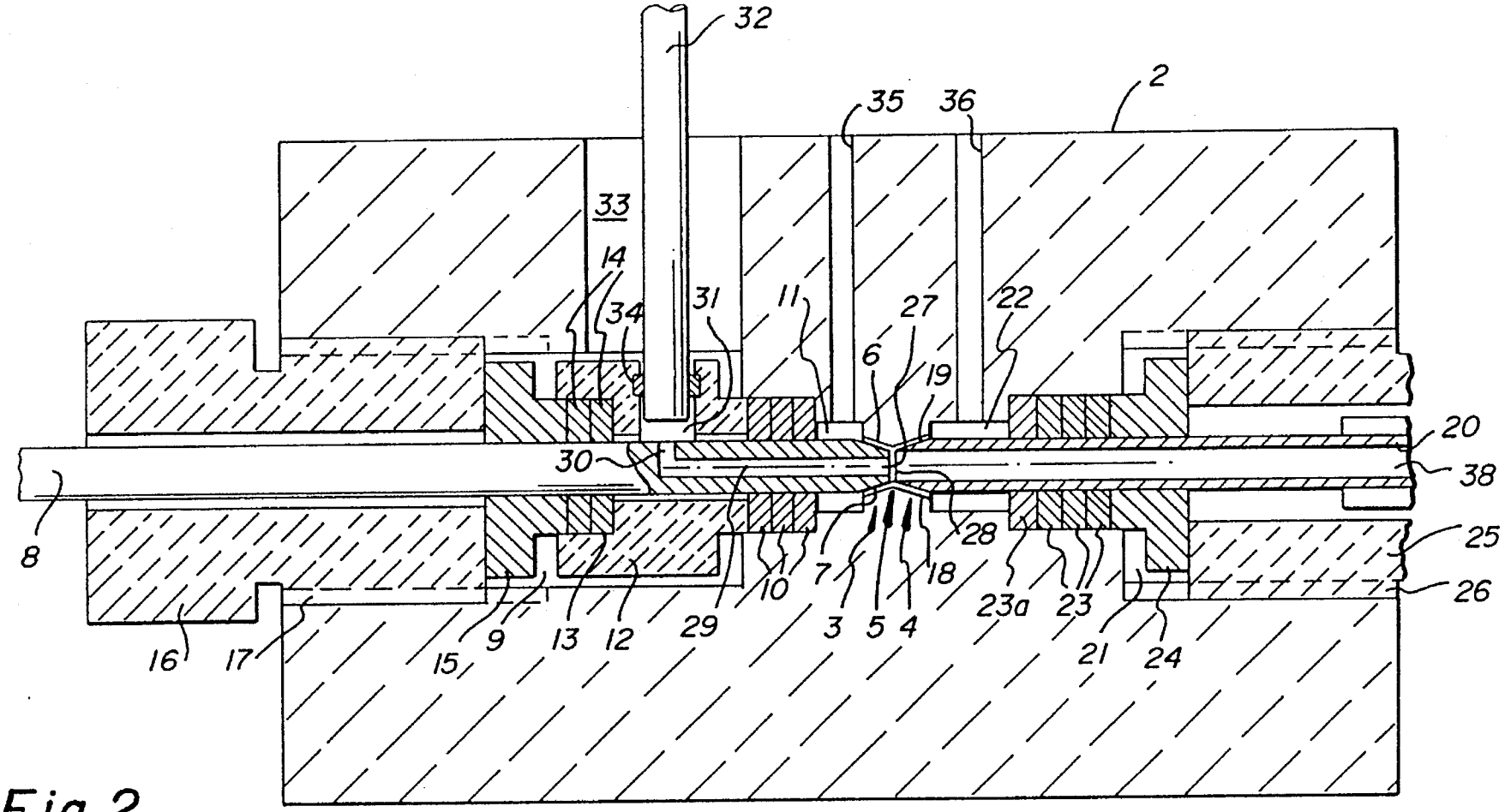
FIG. 2 is an enlarged sectional view of a portion of the apparatus of FIG. 1 which is essential for the invention.
Figure 3:
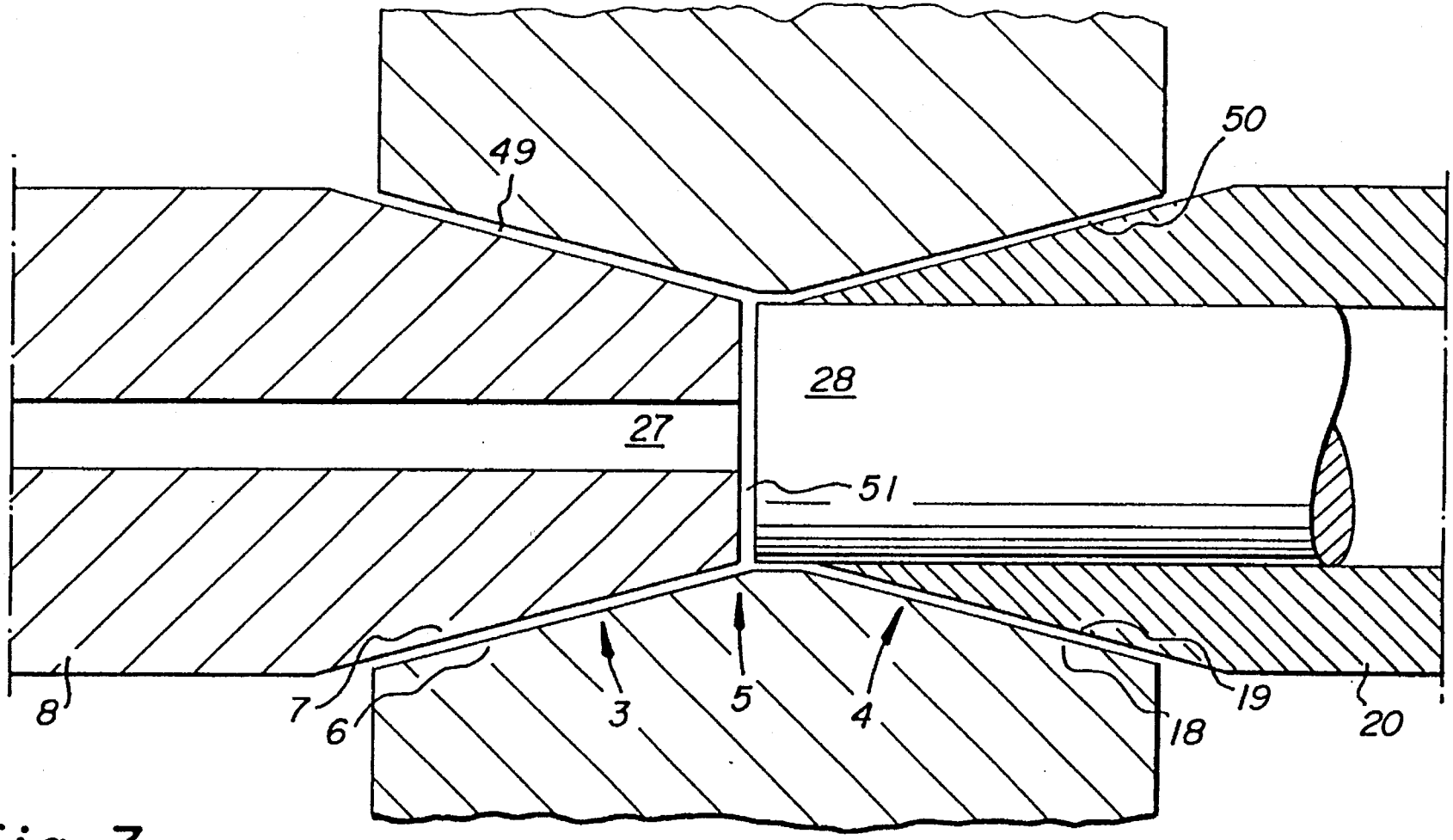
FIG. 3 is a further enlarged sectional view of the mixing region of the apparatus of FIGS. 1 and 2.

Referring now to the figures of the drawing in detail and first, particularly, to FIG. 1 thereof, there is seen an apparatus for mixing essentially immiscible fluids for forming a dispersion, in particular an emulsion, referred to in the drawing generally at 1. The apparatus 1 has a housing 2 in which two mutually opposite expansion valves 3, 4 are disposed. A mixing and outlet valve 5 is centrally disposed therebetween.

Referring now to all of the drawings simultaneously, the expansion valve 3 has a flat-conical valve seat 6 and a correspondingly formed valve cone 7. The valve seat 6 is formed as a conical bore in the housing 2. The valve cone 7 continues in a valve spindle or stem 8 which protrudes from the housing 2 and which cooperates with a non-illustrated nut and a spindle drive. The nut and spindle drive provide for the axial adjustability of the stem 8 and thus of the valve cone 7. The valve cone 7 may be made of high-grade steel or it may be plated industrial diamond.

The valve stem 8 is thereby guided in a bore 9, which expands outwardly in step-like fashion, with further elements therebetween, namely seals 10, which seal the stem 8 relative to an inlet chamber 11 for the inner phase of the emulsion to be formed, a housing insert element 12, which will be explained in detail in the following, with a seal receptacle 13 for seals 14 and a pressure ring 15 for bias-pressing the seals 14 and a sealing nut 16, which is threadable into a correspondingly threaded bore in the housing 2. That thread is indicated a numeral 17.

The other expansion valve 4 for the outer phase of the emulsion to be formed has a flat-conical valve seat 18, which is formed as a bore in the housing 2, and a valve cone 19. The valve cone 19 continues into a valve stem 20 which, just as the valve cone 19, is formed as a hollow shaft whose function will yet be explained. The valve stem 20 is guided in a bore 21 in the housing 2 which extends outwardly away from the mixing chamber in a step-wise fashion and which is sealed off from an inlet chamber 22 for the outer phase of the emulsion to be formed. The inlet chamber 22 is formed by the inner part of the bore 21, by seals 23 with a support ring 23*a*. These seals are sealingly pressure-biased by a pressure ring 24 and a sealing nut 25, which is mountable in the housing bore 21. A thread 26 is used for that purpose.

The mixing and outlet valve 5 is formed of an outlet bore 27 which is centrally and axially disposed in the valve cone 7 of the expansion valve 3 (the outlet bore 27 opens at the front edge of the cone 7), and by a cylindrical stamp 28, which is telescopingly disposed in the valve cone 19 (in a corresponding bore of the same) of the expansion valve 4. The outlet bore 27 of the mixing and outlet valve 5 continues in an axial bore 29 through the valve cone 7 and the valve stem 8 and opens into a radial transverse bore 30 of the valve stem 8. This transverse bore 30 is disposed in the region of the housing insert member 12 in such a way that it opens into a transverse bore 31 of the housing insert member 12 with a greater diameter than the transverse bore 30, such that both bores 30, 31 still communicate when the stem 8 is axially moved. An outlet pipe 32 is inserted into this transverse bore 31 for drawing off the emulsion thus formed. The pipe 32 leads out of the housing 2 through a housing bore 33 and is sealed off against the housing insert element 12 with a seal 34. With the inlet chambers 11, 22 for the inner and outer phases respectively of the emulsion to be formed there are provided inlet conduits 35 for the inner phase and 36 for the outer phase, onto which corresponding, non-illustrated, feed lines are hooked. Especially important, also, are metering pumps or dosing pumps 35*a* and 36*a* which are provided for forming the pressure necessary for the respective phase. The pressurized operation will be explained in more detail in the following.

For providing axial adjustability of the valve cone 19 of the expansion valve 4 relative to the corresponding valve seat 18, the associated valve stem 20, which is formed as a hollow shaft, is provided with a thread 37 at its free end, for instance with a trapezoidal thread. The cylindrical stamp 28 of the mixing and outlet valve 5 is also provided with its own stem 38, which is guided in the hollow shaft of the stem 20 and which protrudes therefrom at its free end, and at the free end it is also provided with a drive thread 39, for instance a trapezoidal thread. The toothed wheels or ratchet wheels 40*a* and 40 are provided for independently driving the two spindles 20 and 38. The ratchet disks cooperate with the threads 37 and 39. It is thereby arranged such that the ratchet wheel 40*a* is rotatably supported on the sealing nut 25, i.e. with a slide ring 41, which is axially fixed by a projection 42 on the sealing nut 25, while the ratchet wheel 40*a* rests on the free end face of the sealing nut 25 and is fixed at the slide ring 41 in the axial direction (attachment elements 43). The ratchet wheel 40*a* itself sits on a sliding pin 44 and it is rotationally fixed thereon via fixation elements 45. This sliding pin 44 has an inner thread, which cooperates with the thread 37 of the stem 20.

The ratchet wheel 40 for the spindle 39 is rotatably supported on the free end of the slide pin 44 with a sliding ring 46 and corresponding attachment elements 47, and it is fixed in an axial direction (protrusion 48 on the sliding pin 44). When the valve cone 19 of the expansion valve 4 is to be adjusted in an axial direction relative to the valve seat 18, then the ratchet wheel 40*a* is rotated, which simultaneously rotates the sliding pin 44, and which causes the spindle 20 to be axially moved by way of the trapezoidal thread 37. The spindle 38 of the telecope stamp 28 of the mixing and outlet valve 5 is thereby not affected, because the ratchet wheel 40 is supported freely rotatable on the sliding pin 44. When the spindle 38 is to be adjusted axially for the purpose of adjusting the mixing and outlet valve 5, then the ratchet wheel 40 is to be operated, which does not influence the ratchet wheel 40*a* or the spindle 20. All of the valves 3, 4 and 5 are thus independently adjustable.

The process with the above-described apparatus 1 proceeds as follows:

Depending on the dispersion or emulsion to be produced, i.e. depending on the properties of the respective inner and outer phases, the valves 3, 4 and 5 are adjusted by a corresponding axial adjustment of the valve cones relative to the valve seats, which allows for the adjustment of the width of valve clearances 49 and 50, which form entrance slits for the phases into the mixing chamber. There is provided, for instance for the expansion valve 3 for the inner phase (e.g. oil) a clearance of approximately 30 μm, i.e. a very narrow clearance width is adjusted. The valve clearance of the expansion valve 4 for the outer phase (e.g. water) is adjusted in the same order of magnitude.

The two phases are pumped into the apparatus independently and separately from one another through the inlet conduits 35 and 36 by means of the associated dosing pumps 35*a* and 36*a*, respectively, and under different pressures (for the inner phase oil, e.g. about 1,000 bar and for the outer phase water up to 100 bar). The two phases enter into the respective valve clearances 49, 50 through the inlet chambers 11 and 22. When the liquid of the inner phase passes through the valve clearance 49, it is fragmented. Due to the very narrow, radially disposed slit and the high pressure, very much energy is dissipated and the exiting liquid of the inner phase leaves the clearance 49 at high velocity in a thin, radially flat sheet in a two-phase condition, which is partially liquid and partially vaporous and, in this form, impinges on the approching liquid jet of the outer phase coming from the valve clearance 50 of the expansion valve 4. The clearance 50 between the valve cone 19 and the valve seat 18 of the expansion valve 4 is adjusted so as to provide that flow a thin, radially flat sheet shape as well.

The two jets of the two phases meet in the middle and they mix under great turbulence within the mixing chamber or slit 51, which is formed by the stamp 28 and the oppositely disposed valve cone 7. The emulsion thus forming flows off through the central outlet bore 27 of the valve cone 7 and then through the bore 29. That exciting is accompanied by an additional mixing with final particulization in a turbulent current. The emulsion is then taken off through the outlet pipe 32.

As mentioned above, the invention is not limited to the embodiment shown in the drawing. For instance, the process according to the invention is not only suitable for forming emulsions, but also for producing other dispersions.

It is essential, however, in the context of the instant invention, that no premixing of the two phases takes place, that they are independently subjected to different pressures and that they are guided towards each other in flat current jets.

I claim:

1. Process for homogenizing essentially immiscible liquids for forming an emulsion, which comprises:

guiding an inner phase of a liquid towards a mixing region under a given high pressure;

guiding an outer phase of a liquid towards the mixing region under a relatively lower pressure than the given high pressure;

forming jets of thin, radially flat sheets with the inner and outer phases by guiding each of the phases through a respective narrow, radially disposed slit and thereby accelerating each of the phases;

colliding the thin, radially flat sheets of the inner and outer phases in a counter-current for forming a homogenized phase mixture; and subsequently withdrawing the homogenized phase mixture from the mixing region.

* * * * *